US007351091B1

(12) United States Patent
Zhang

(10) Patent No.: US 7,351,091 B1
(45) Date of Patent: Apr. 1, 2008

(54) HEADER CONNECTOR

(75) Inventor: George (Huanyi) Zhang, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/648,000

(22) Filed: Dec. 28, 2006

(51) Int. Cl.
*H01R 11/20* (2006.01)

(52) U.S. Cl. ..... 439/405; 439/459

(58) Field of Classification Search ..... 439/405, 439/375, 456, 492, 404, 459
See application file for complete search history.

(56) References Cited

U.S. PATENT DOCUMENTS 5,055,069 A * 10/1991 Townsend et al. ..... 439/608
6,071,152 A * 6/2000 Achammer et al. ..... 439/733.1
6,132,241 A * 10/2000 Hwang ..... 439/459
6,142,821 A * 11/2000 Hwang ..... 439/459
6,171,134 B1 * 1/2001 Lai ..... 439/405
6,655,980 B2 * 12/2003 Lee ..... 439/358
6,666,706 B1 * 12/2003 Jones et al. ..... 439/405
6,817,887 B2 * 11/2004 Jones et al. ..... 439/405

* cited by examiner

*Primary Examiner*—Michael C. Zarroli
*Assistant Examiner*—Phuongchi Nguyen
(74) *Attorney, Agent, or Firm*—Wei Te Chung

(57) ABSTRACT

A header connector comprises an elongate insulative housing (1) which has longitudinal walls, a plurality of terminals (4) retained in the housing, and the terminals are disposed as two types through hole-type terminals (41, 42) and surface mounted technology type terminals (43). Thus, the connector can provide an improved terminals distribution, which can meet different current and signal transmitted through, and the terminals arrangement can be designed as different distribution for meeting different signal transmission demand.

10 Claims, 8 Drawing Sheets

5

HEADER CONNECTOR

BACKGROUND OF THE INVENTION

1. Field of the Invention

The present invention relates to a header connector, and particularly to a header connector with an improved terminals arrangement for meeting the electrical performance requirement.

2. Description of Related Art

Almost every computer is equipped with a header connector, for example, in U.S. Pat. No. 5,094,924 which issued to Patrick D. Bakke et al. on Nov. 10, 1992, U.S. Pat. No. 5,021,004 which issued to Francis M. Heiney et al. on Jun. 4, 1991 for engaging with a cable end connector or other connectors which connects with a hard disk drive to establish an electrical connection between the hard disk drive and a printed circuit board on which the header connector is mounted. A conventional header connector comprises an elongate insulative housing having two longitudinal walls and two lateral walls, and a plurality of pin-type terminals retained in the housing. Each terminal includes a mating portion for electrically engaging with a corresponding terminal of a complementary cable end connector, and a tail portion for electrical connection with a printed circuit board. However, the terminals arranged in the connector are usually configured into through hole with tail portions inserted into the through hole of the printed circuit board and arranged with same space with each other, which do not provide a solution for specified signal requirement for the next generation of the electronic transmission, particularly for a transmission requirement with a higher speed.

Hence, a header connector with an improved terminals arrangement is required to overcome the disadvantages of the related art.

SUMMARY OF THE INVENTION

Accordingly, one object of the present invention is to provide a header connector with a differentiated terminals arrangement for providing an enhanced electrical connector with higher transmitting performance.

In order to achieve the objects set forth, a header connector in accordance with the present invention comprises an elongate insulative housing which has longitudinal walls, a plurality of terminals retained in the housing, and the terminals are disposed as two types through hole-type terminals and surface mounted technology type terminals. Thus, the connector can provide an improved terminals distribution, which can meet different current and signal transmitted through, and the terminals arrangement can be designed as different distribution for meeting different signal transmission demand.

Other objects, advantages and novel features of the invention will become more apparent from the following detailed description when taken in conjunction with the accompanying drawings.

DETAILED DESCRIPTION OF THE INVENTION

Figure 1:
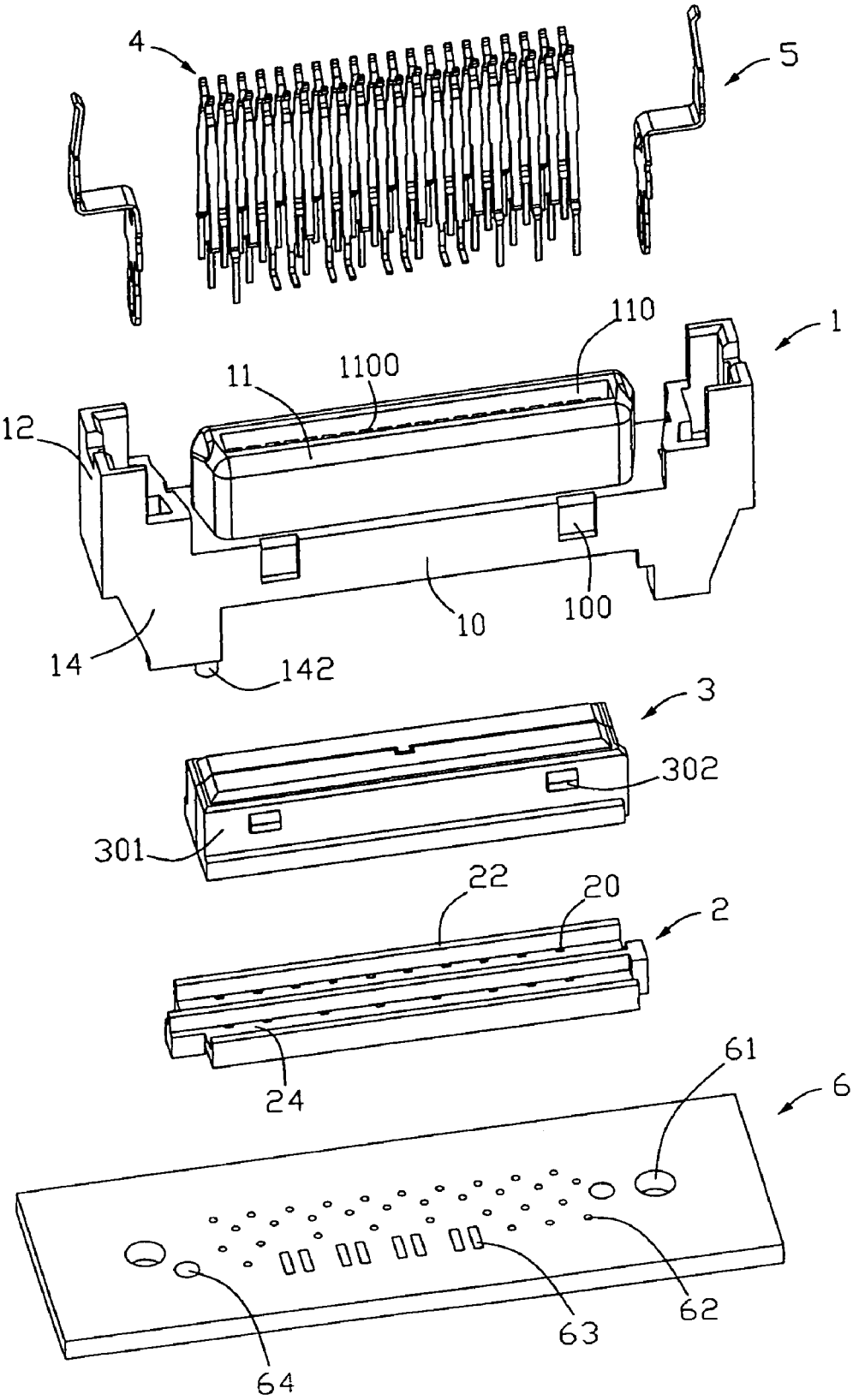
FIG. 1 is an exploded, isometric view of a header connector in accordance with the embodiment of the present invention.
Figure 2:
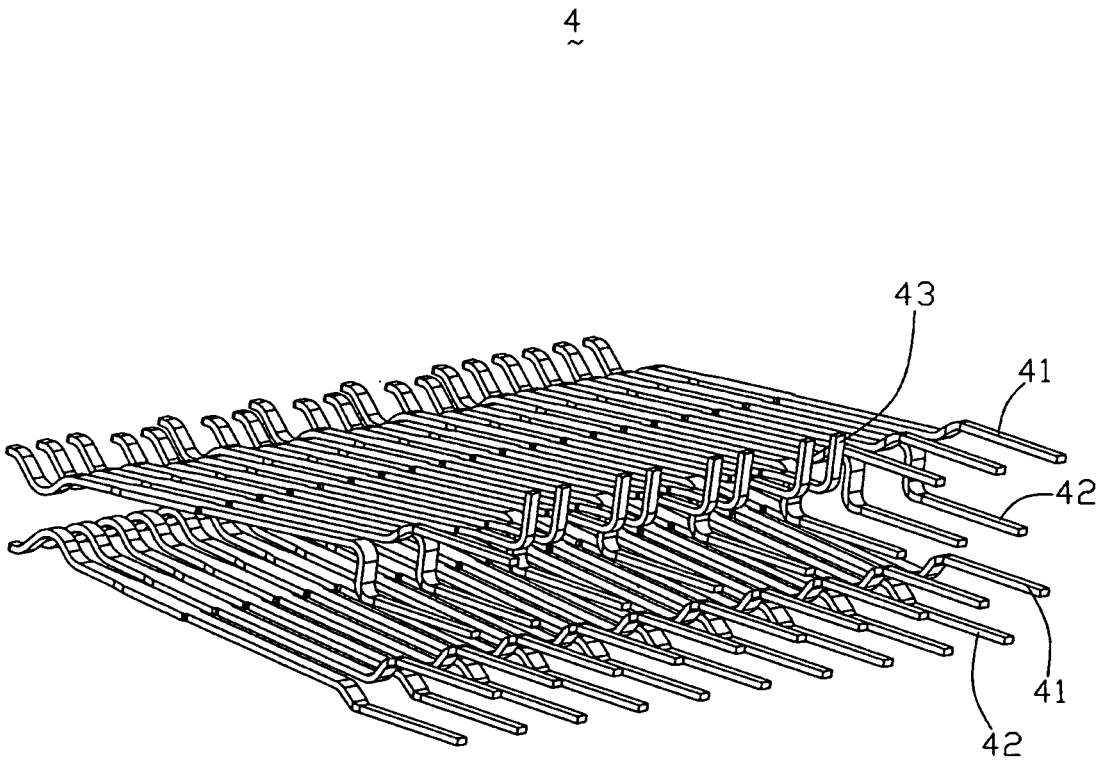
FIG. 2 is an assembled, perspective view of the terminals of the header connector in FIG. 1.
Figure 3:
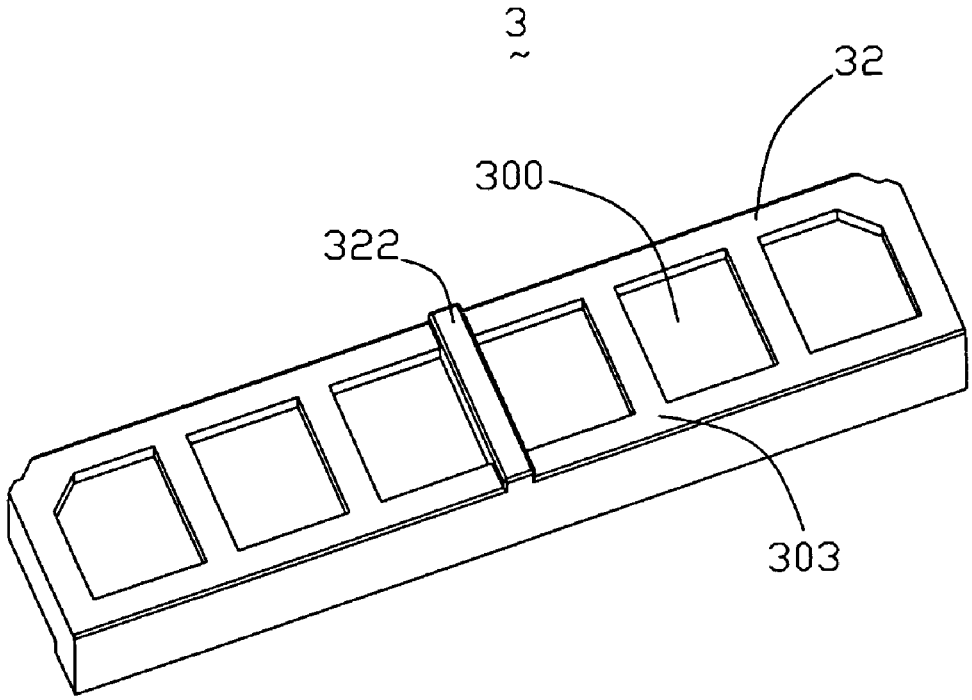
FIG. 3 is a perspective view of the second pin-type terminal of the terminals shown in FIG. 2.
Figure 4:
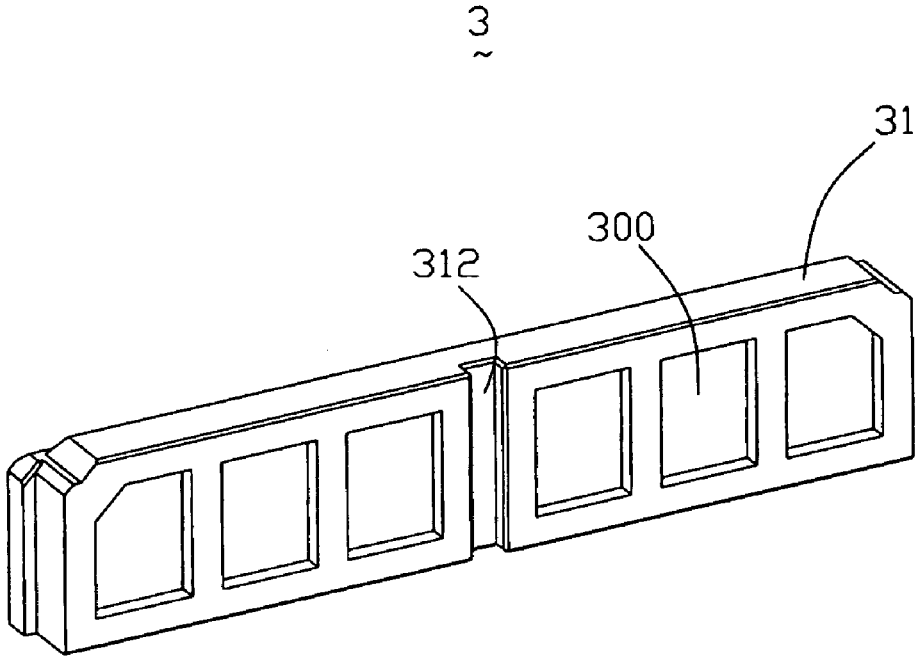
FIG. 4 is a perspective view of the surface mounted technology type terminal of the terminals shown in FIG. 2.

Referring to FIG. 1, a header connector assembly in accordance with a first embodiment of the present invention comprises an elongate insulative housing 1, a plurality terminals 4 retained in the housing 1, the terminals 4 electrically connecting the outer components to a printed circuit board 6, a securing member 3 received in the housing for securely holding the terminals 4 passing through, a positioning plate 2 for connecting the securing member 3 to the printed circuit board 6, and a pair of detecting contact 5 being inserted through the housing 1, and the printed circuit board 6.

The housing 1 defines a body portion 10, an extending portion 11 extending upwardly from the body portion 10 having a receiving cavity 110 through a mating face, and a plurality of passageways 1100 upwardly extending from a mounting face 102 to communicate with the receiving cavity 110. For polarization and alignment purposes, a pair of projected portions 12 extending upwardly from two opposite ends of the body portion 10 for engaging with other connectors, and a pair of supporting portions downwardly extending from the body portion for supporting the connector on the printed circuit board 6. Each projected portion 12 defines a cutout 120 in an upper-to-lower direction for receiving the detecting contact 5 therein. In addition, one of the supporting portions defines a locating pin 142 to connect with the printed circuit board 6 on a bottom surface thereof.

Figure 5:
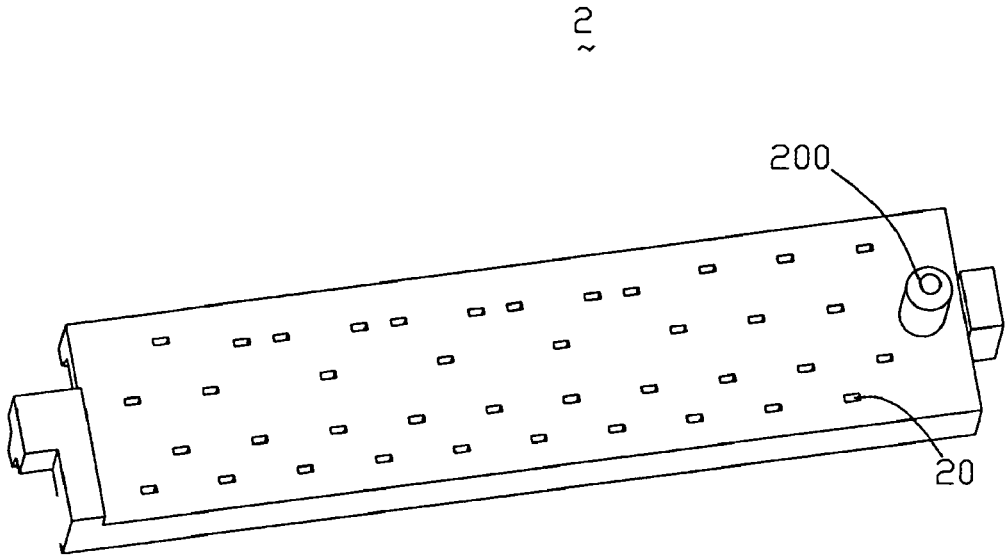
FIG. 5 is a perspective view of the first pin-type terminal of the terminals shown in FIG. 2.
Figure 6:
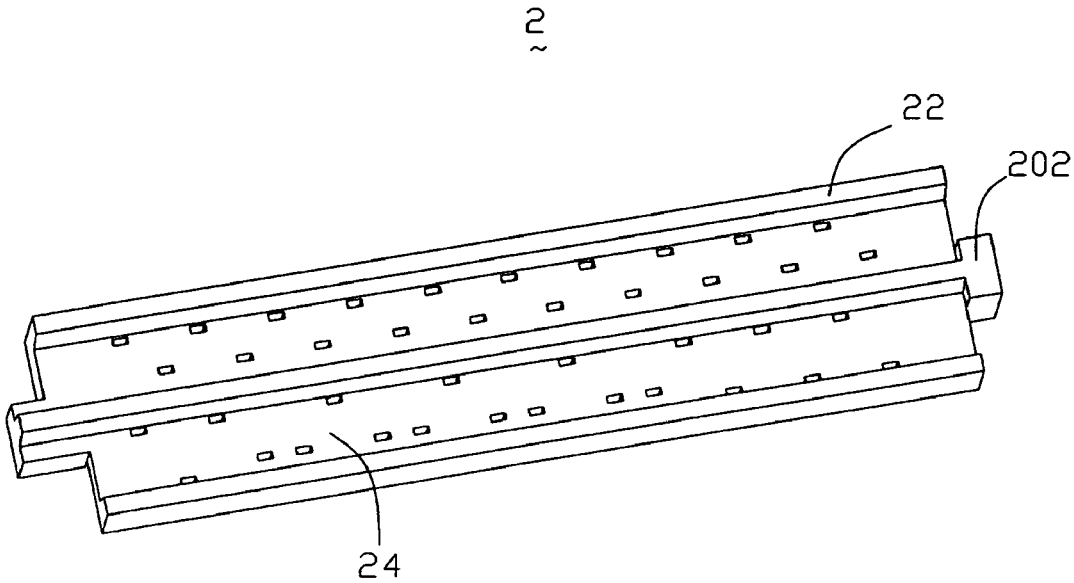
FIG. 6 is a perspective view of the detecting contact shown in FIG. 2.
Figure 7:
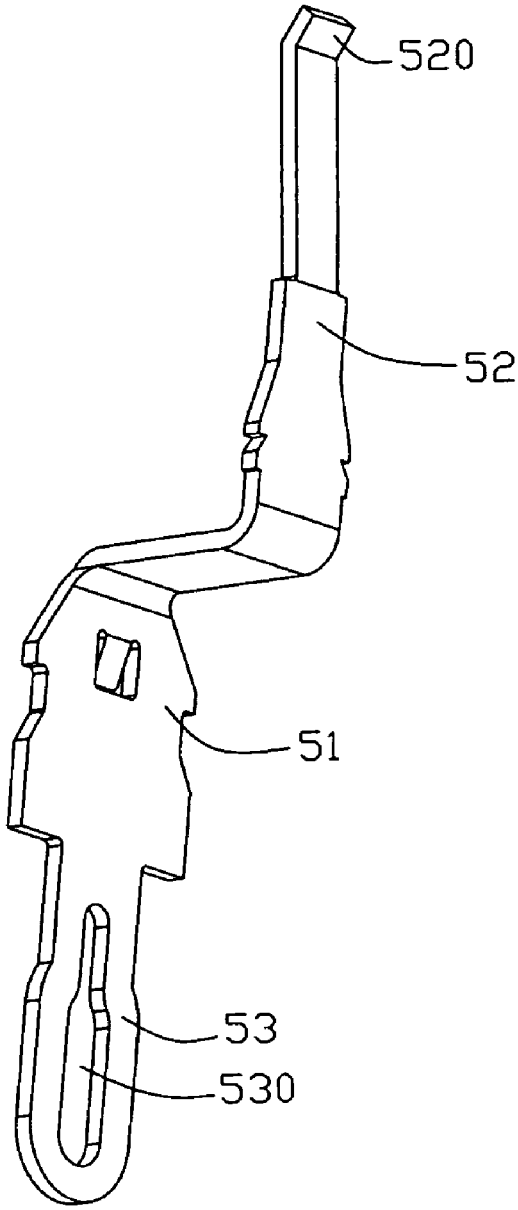
FIG. 7 is a perspective view of the male part of the securing member in FIG. 1.
Figure 8:
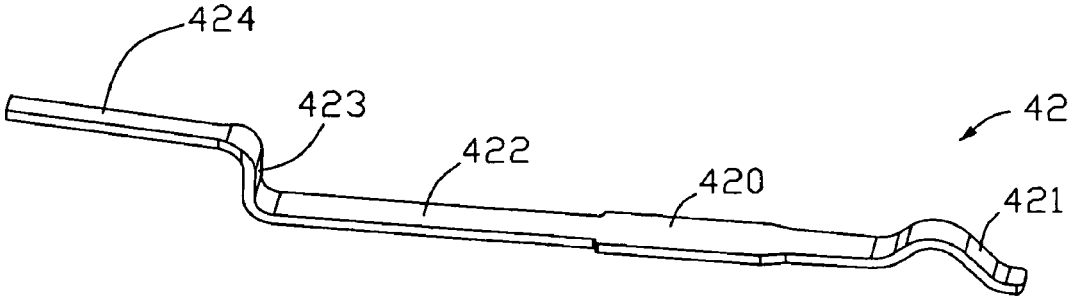
FIG. 8 is a perspective view of the female part of the securing member in FIG. 1.
Figure 9:
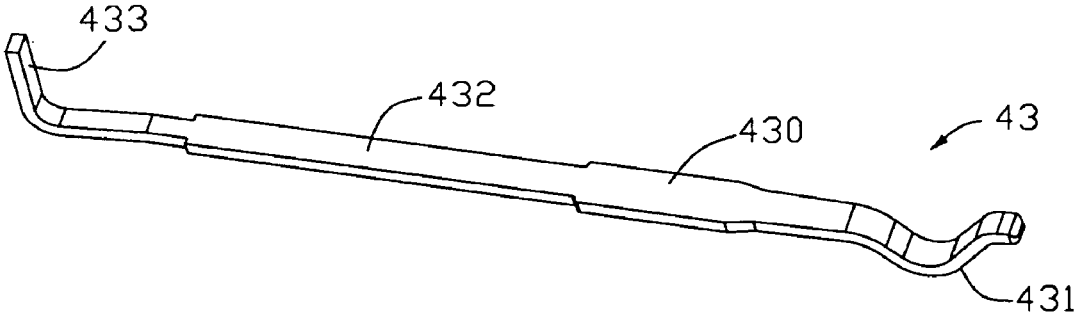
FIG. 9 is a bottom view of the positioning plate in FIG. 1.
Figure 10:
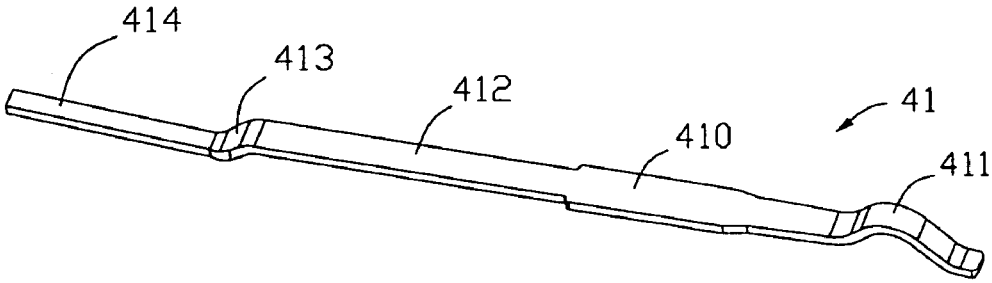
FIG. 10 is a top view of the housing in FIG. 1.
Figure 11:
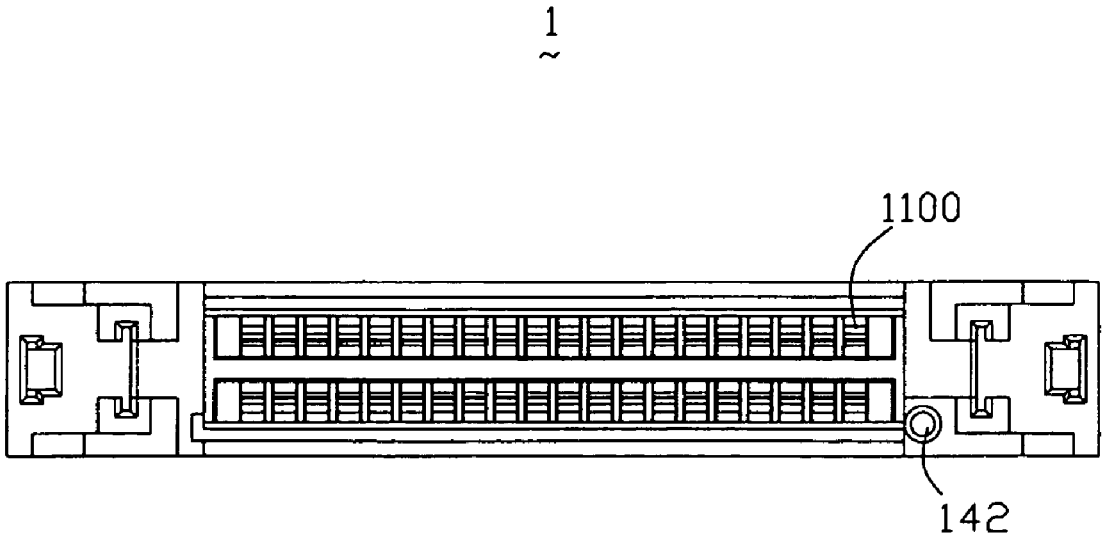
FIG. 11 is a bottom view of the positioning plate in FIG. 1.
Figure 12:
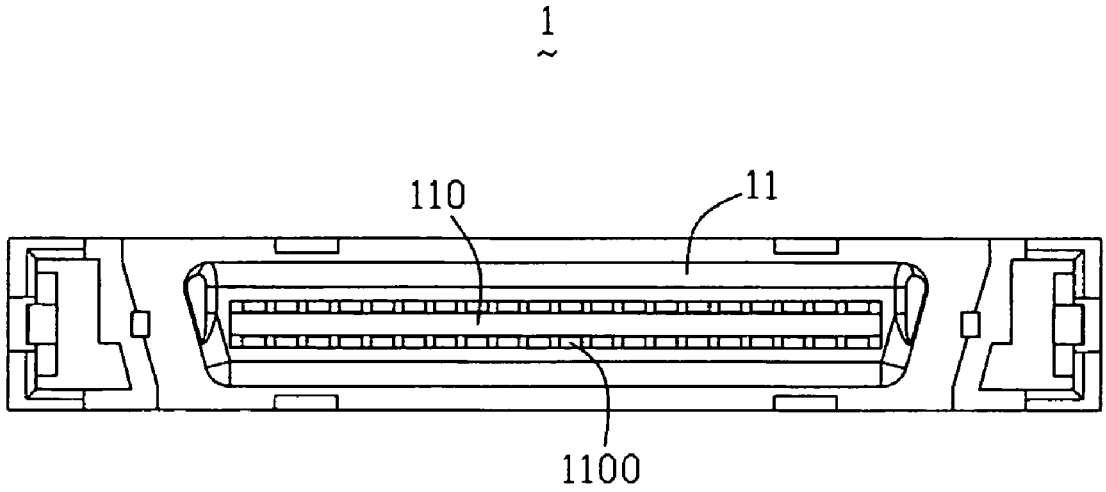
FIG. 12 is a top view of the housing in FIG. 1.
Figure 13:
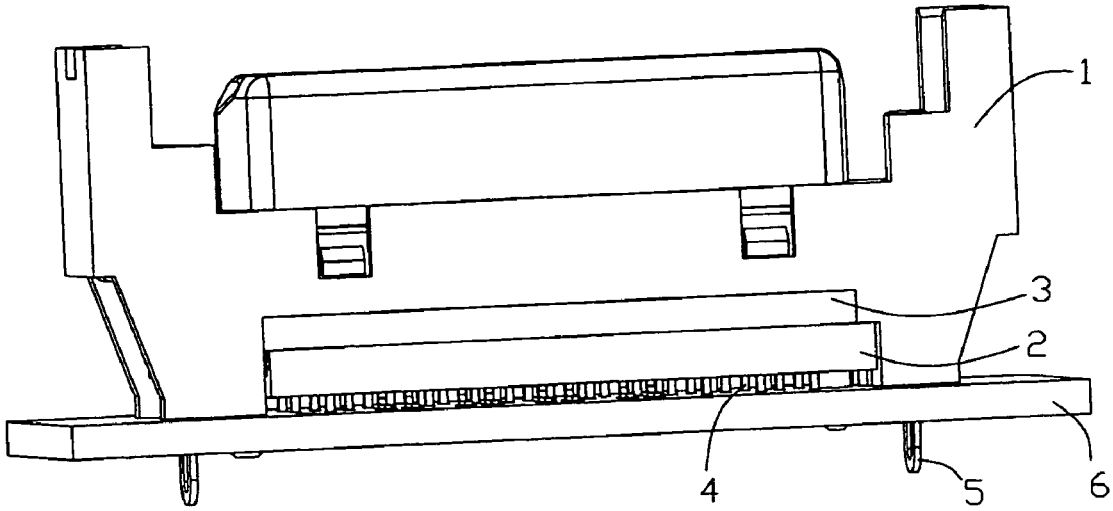
FIG. 13 is an assembled, perspective view of the header connector in FIG. 1.

Also referring to FIG. 5, the terminals 4 comprise a number of pin-type terminals 41 including first pin-type terminals and second pin-type terminals 42 and a number of surface mounted technology type terminals 43. the pin-type terminals 41, 42 and surface mounted technology type terminals 43 are all received in the passageways 1100 of the housing 1. The first pin-type terminal 41 comprises a base section 410, a curved contacting section 411 extending upwardly from the base section 410, a securing section 412 received in the securing member 2 extending downwardly from the base section 41 and an inserting section 414 disposed at a distal end thereof for being inserted into corresponding holes of the printed circuit board 6, and a slant section 413 connecting with the contacting section 414 and the securing section 412. Each second pin-type terminal 42 includes a base portion 420 engaging with the passageways 1100 of the housing 1, a securing portion 422 extending downwardly from the base portion 420, a mating portion 421 disposed in the cavity 110 for engaging with a corresponding terminal of the complementary cable end connector, and a tail portion 424 projecting beyond the mounting face 102 of the housing 1 for electrical connection with the printed circuit board 6 on which the connector is mounted, and a bend portion 423 connecting with the tail portion 424 and the securing portion 422 angled from the securing portion 422 substantially 90 degree. The surface mounted technology type terminal 43 comprises a base 430 engaging with passageways 1100 of the housing 1, a contacting portion 431 extending upwardly from the base 430, an anchoring portion 432 secured in the securing member 2 and a bent portion 433 bended from a distal end of the anchoring portion 432 for connecting with the printed circuit board 6 by surface mounted technology.

The securing member 3 is configured as rectangular shape and comprises a male part 31 and a female part 32 each comprising an engaging surface 303 for engaging with each other. In addition, the male part 31 defines an engaging recess 312; the female part 32 defines a projected engaging member 322 for engaging with the engaging recess 312 to connecting the securing members together. The male part 31 and the female part 32 each define a plurality of spaced cavities 300 besides the engaging member 322 or engaging recess 312 for receiving the corresponding parts of the terminals 4 therein.

The detecting contact 5 comprises a body 51, an engaging member 52 extending and bent from the body 51 with a bent contacting part 520 on a top end thereof, and an inserting member 53 extending downwardly from the body for engaging with the printed circuit board defining a irregular recess 530. The detecting contact 4 is used for detecting the connection condition between other components and the connector.

The positioning plate 2 is formed as a rectangular shape and comprises a number of through hole 20 corresponding to the passageways 1100 of the housing 1 for locating and receiving the terminals 4 therein and there spaced projected members 22 extending upwardly from an upper surface thereof in a lengthwise direction forming two receiving space 24 for receiving the securing members 3 therein, and a positioning pin 200 extending downwardly from a lower surface for connecting with the printed circuit board 6.

The printed circuit board 6 comprises a number receiving holes 62 for receiving the terminals 4 therein and a pair of though holes 61 for receiving the detecting contacts 5, and a pair of locating holes 64 for receiving the locating projection 200 and the locating pin 142 therein.

Referring to FIGS. 2-6, in assembly, the pin-type terminals 41, 42 and surface mounted technology type terminals 43 are firstly inserted into the securing member 3 with the securing portions 422 or securing sections 412 or anchoring sections 432 being received in the cavities 300 of the securing member 3. The terminals 44 are arranged in two rows. Terminals 4 of first row are all arranged by the first 41 and second pin-type terminals 2, which are spaced arranged with each other. The other row is spaced arranged by the first and second pin-type terminals 41, 42 and the surface mounted technology type terminals 43 and the first and second pin-type terminals 41, 42 are disposed on two lateral ends with the surface mounted technology type terminals 43 sandwiched by the pin-type terminals 41, 42. Then the securing member 3 assembled with the terminals 4 are inserted into the receiving spaces 24 of the positioning plate 2, at the moment, the securing members 3 are inserted into the receiving slot 104 of the housing 1 with the pin-type terminals 41, 42 and surface mounted technology type terminals 43 being inserted into the passageways 1100 of the housing 1 and the contacting sections 414 or mating portions 421 or contacting portions 431 of the terminals 4 exposed in the cavity 110 of extending member 11. Successively, the assembled housing 1 with terminals 4 therein is mounted onto the printed circuit board 6 with the locating pin 142 of the housing and the positioning pin 200 of the securing member 3 being inserted into the locating holes 64 of the printed circuit board 6. The pin-type terminals 41, 42 are inserted into the receiving holes 62 of the printed circuit board 6 and the surface mounted technology type terminals 43 are attached to solder sections 63 of the printed circuit board 6. At last the detecting contacts 5 are inserted though the recess 120 of the housing 1 and the holes of the printed circuit board 6 projected outwardly from a bottom surface of the printed circuit board 6.

When the header connector defines a plurality of terminals retained in the housing, and the terminals are disposed as two types through hole-type terminals and surface mounted technology type terminals. Thus, the connector can provide an improved terminals distribution, which can meet different current and signal transmitted through, and the terminals arrangement can be designed as different distribution for meeting different signal transmission demand.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical header connector comprising:

an insulative housing having a number of though passageways;

a plurality of terminals retained in the passageways of the insulative housing; and wherein the terminals comprise a number of pin-type terminals and a number of surface mounted technology type terminals;

wherein the terminals are arranged with two rows, one with all pin-type terminals, the other with pin type terminals and surface mounted technology-type terminals being mixed;

wherein the housing defines a receiving cavity through a mating face thereof, and wherein each terminal includes a mating portion disposed in the receiving cavity for engaging with a corresponding terminal of a complementary connector;

wherein defines a pair of projected portion extending upwardly from two opposite ends of the housing each with a recess extending therethrough in an upper-to-lower direction;

wherein the housing further defines a number of cutouts in communication with the receiving cavity for engaging with corresponding projections of the securing members;

wherein a securing member having a number of receiving cavities assembled into a receiving slot of the housing for receiving corresponding parts of the terminals projected in the receiving slot;

wherein the securing member comprises a male part with a first engaging surface and a female part with a second engaging surface engaging with the first engaging surface, the first securing member defines an engaging member projected from the first engaging surface and the second securing member defines an engaging recess recessed from the second engaging surface for engaging with the engaging member;

wherein a positioning plate defining a number of second passageways for receiving terminals therein and forming a pair receiving channels for receiving the corresponding securing members therein.

2. The electrical connector as claimed in claim 1, wherein the positioning plate further defines three spaced extending walls for forming the receiving channels therebetween.

3. The electrical connector as claimed in claim 1, wherein the positioning plate further defines a projected member extending upwardly from one end in a lengthwise direction thereof for providing a positioning datum to the securing members received therein.

4. The electrical connector as claimed in claim 1, wherein the positioning plate further defines a positioning pin extending from a bottom surface thereof for engaging with the printed circuit board.

5. The electrical connector as claimed in claim 1, wherein the housing comprises further a locating pin extending from a bottom surface thereof for engaging with the printed circuit board.

6. The electrical connector as claimed in claim 1, wherein the housing further defines a number of cutouts in communication with the receiving cavity for engaging with corresponding projections of the securing members.

7. The electrical header connector as claimed in claim 1, wherein housing defines two towers at two opposite ends each receiving a grounding tang therein, and a bottom portion of the tower is inwardly chamfered to allow a tail of the grounding tang to be proximate an end around the bottom portion.

8. The electrical connector as claimed in claim 1, wherein pin-type terminals including first pin-type terminals and second pin-type terminals.

9. The electrical connector as claimed in claim 8, wherein the first pin-type terminal comprises a base section, a curved contacting section extending upwardly from the base section, a securing section received in the securing member extending downwardly from the base section and an inserting section disposed at a distal end thereof for being inserted into corresponding holes of the printed circuit board, and a slant section connecting with the contacting section and the securing section.

10. The electrical connector as claimed in claim 8, wherein the second pin-type terminal includes a base portion engaging with the passageways of the housing, a securing portion extending downwardly from the base portion, a mating portion disposed in the cavity for engaging with a corresponding terminal of the complementary cable end connector, and a tail portion projecting beyond the mounting face of the housing for electrical connection with the printed circuit board on which the connector is mounted, and a bend portion connecting with the tail portion and the securing portion angled from the securing portion substantially 90 degree.

* * * * *